US010652643B2

(12) United States Patent
Lin et al.

(10) Patent No.: US 10,652,643 B2
(45) Date of Patent: May 12, 2020

(54) ADJUSTABLE IN-EAR PLUG

(71) Applicant: Microsoft Technology Licensing, LLC, Redmond, WA (US)

(72) Inventors: Jason Lin, Redmond, WA (US); Kaitlyn M. Schoeck, Seattle, WA (US); Randal Joseph Kinser, Lynnwood, WA (US); Young S. Kim, Bellevue, WA (US); Olli-Pekka Ahokas, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/957,251

(22) Filed: Apr. 19, 2018

(65) Prior Publication Data

US 2019/0327549 A1 Oct. 24, 2019

(51) Int. Cl.
*H04R 1/10* (2006.01)

(52) U.S. Cl.
CPC ..... *H04R 1/1016* (2013.01)

(58) Field of Classification Search
USPC ..... 381/379, 380, 325
See application file for complete search history.

(56) References Cited

U.S. PATENT DOCUMENTS 6,129,174 A * 10/2000 Brown ..... H04R 25/656 181/135
7,684,583 B2 * 3/2010 Yang ..... H04R 1/1016 379/430
8,737,664 B2 * 5/2014 Tiscareno ..... H04R 1/2896 381/23.1
2003/0081805 A1 * 5/2003 Fushimi ..... H04R 1/1016 381/325
2009/0116677 A1 * 5/2009 Jones ..... H04R 1/1016 381/380
2010/0246879 A1 * 9/2010 Siahaan ..... B29C 43/021 381/380
2012/0155689 A1 * 6/2012 Milodzikowski .... H04R 1/1016 381/379

(Continued)

FOREIGN PATENT DOCUMENTS

KR 101411380 B1 6/2014
KR 101473474 B1 * 1/2015

(Continued)

OTHER PUBLICATIONS

"International Search Report and Written Opinion Issued in PCT Patent Application No. PCT/US19/025691", dated Jul. 16, 2019, 15 Pages.

*Primary Examiner* — Quoc D Tran
(74) *Attorney, Agent, or Firm* — Holzer Patel Drennan

(57) ABSTRACT

Generic adjustable in-ear monitors (IEMs) may suffer from a limited range of resilient ear plugs that may not adequately fit each user, and the user may prefer different ear plugs for different purposes (e.g., the user's interest in secure fitment may be higher when exercising, while the user's interest in comfort may be higher when the user is relaxing). The presently disclosed technology is directed to IEMs that permit a user to adjust without removing and replacing an associated ear plug. Instead, the ear plug is adjustable by the user to achieve a desired fit and may be adjusted repeatedly for different desired fits and/or different users.

19 Claims, 9 Drawing Sheets

(56) References Cited

U.S. PATENT DOCUMENTS

| | | | | |
|---|---|---|---|---|
| 2013/0092470 | A1 | 4/2013 | Johnston et al. | |
| 2013/0170692 | A1* | 7/2013 | Kaneko | H04R 1/1016 381/380 |
| 2014/0286521 | A1* | 9/2014 | Yang | H04R 1/1041 381/380 |
| 2019/0116412 | A1* | 4/2019 | Prelogar | H04R 1/1016 |

FOREIGN PATENT DOCUMENTS

| | | | |
|---|---|---|---|
| KR | 101473474 | B1 | 1/2015 |
| WO | 2009086555 | A1 | 7/2009 |

* cited by examiner

ADJUSTABLE IN-EAR PLUG

BACKGROUND

In-ear monitors (IEMs), which are also known as in-ear headphones, canalphones, and in-ear buds, are electronic devices that include at least one electroacoustic transducer, which converts an input electrical signal supplied to the IEMs into a corresponding audio output. A portion of each IEM is inserted into a user's ear canal and physically interfaces with and seals against the user's ear canal walls to provide a path for the audio output generated by the IEM to the user's ear drum.

Some IEMs are custom fit for a user and adapted to the user's unique ear canal size and shape. However, custom IEMs are expensive and only adapted for a single user. Other IEMs are generic and include a single ear plug (or resilient membrane tip) size and shape that is intended to substantially resiliently deform and subsequently expand to fit multiple ear canal sizes and shapes. However, the lack of adjustability of these generic IEMs prevent their performance from being adequate for all users in all situations.

Other generic IEMs include an array of removable resilient ear plugs (or resilient membrane tips) to adapt the generic IEMs for multiple ear canal sizes and shapes. For these types of IEMs, the user chooses the resilient ear plugs that best match the user's ear canal by trying different ear plugs and selecting the one that provide the best perceived seal, level of comfort, and/or secure fitment. These sorts of generic IEMs may suffer from a limited range of resilient ear plugs that may not adequately fit each user, and the user may prefer different ear plugs for different purposes (e.g., the user's interest in secure fitment may be higher when exercising and lower when relaxing).

SUMMARY

Implementations described and claimed herein provide an adjustable in-ear plug comprising an adjustment mechanism including a center post and an adjustment collar concentric with the center post. The adjustable in-ear plug further comprises a resilient membrane tip also concentric with the center post and covering a portion of the adjustment mechanism. Rotation of the adjustment collar with reference to the center post changes an outside diameter of the resilient membrane tip.

Implementations described and claimed herein further provide a method of using an adjustable in-ear plug comprising grasping in a user's first hand a main housing of the adjustable in-ear plug, the main housing in fixed relation to a center post; grasping in a user's second hand a resilient membrane tip of the adjustable in-ear plug, the resilient membrane tip in fixed relation to an adjustment collar concentric with the center post, the resilient membrane tip covering a portion of an adjustment mechanism that includes the center post and the adjustment collar; and rotating the resilient membrane tip with reference to the main housing, which in turn rotates the adjustment collar with reference to the center post thereby changing an outside diameter of the resilient membrane tip.

Implementations described and claimed herein still further provide an adjustable in-ear monitor comprising a sound tube having a threaded distal end; an adjustment tube having a threaded proximal end, the adjustment tube concentric with the sound tube, and the proximal end of the adjustment tube screwed onto the distal end of the sound tube; a resilient membrane tip concentric with the sound tube and covering the adjustment tube, the resilient membrane tip having a first end fixed to the adjustment tube; and an adjustment ring concentrically oriented around the sound tube, rotatable with reference to the base sound tube, and fixed linearly along the sound tube. A second end of the resilient membrane tip is attached to the adjustment ring and rotation of the adjustment tube with reference to the base sound tube changes an outside diameter of the resilient membrane tip.

Other implementations are also described and recited herein. This Summary is provided to introduce a selection of concepts in a simplified form that are further described below in the Detailed Descriptions. This Summary is not intended to identify key features or essential features of the claimed subject matter, nor is it intended to be used to limit the scope of the claimed subject matter.

BRIEF DESCRIPTIONS OF THE DRAWINGS

DETAILED DESCRIPTIONS

The presently disclosed technology is directed to adjustable in-ear monitors (IEMs) that permit a user to adjust the IEMs without removing and replacing an associated ear plug (or resilient membrane tip). Instead, the ear plug is adjustable by the user to achieve a desired fit and may be adjusted repeatedly for different desired fits and/or different users. The disclosed adjustable IEMs are intended to address some or all of the foregoing problems with prior IEMs, as well as additional problems with prior IEMs not specifically identified herein.

Figure 1:
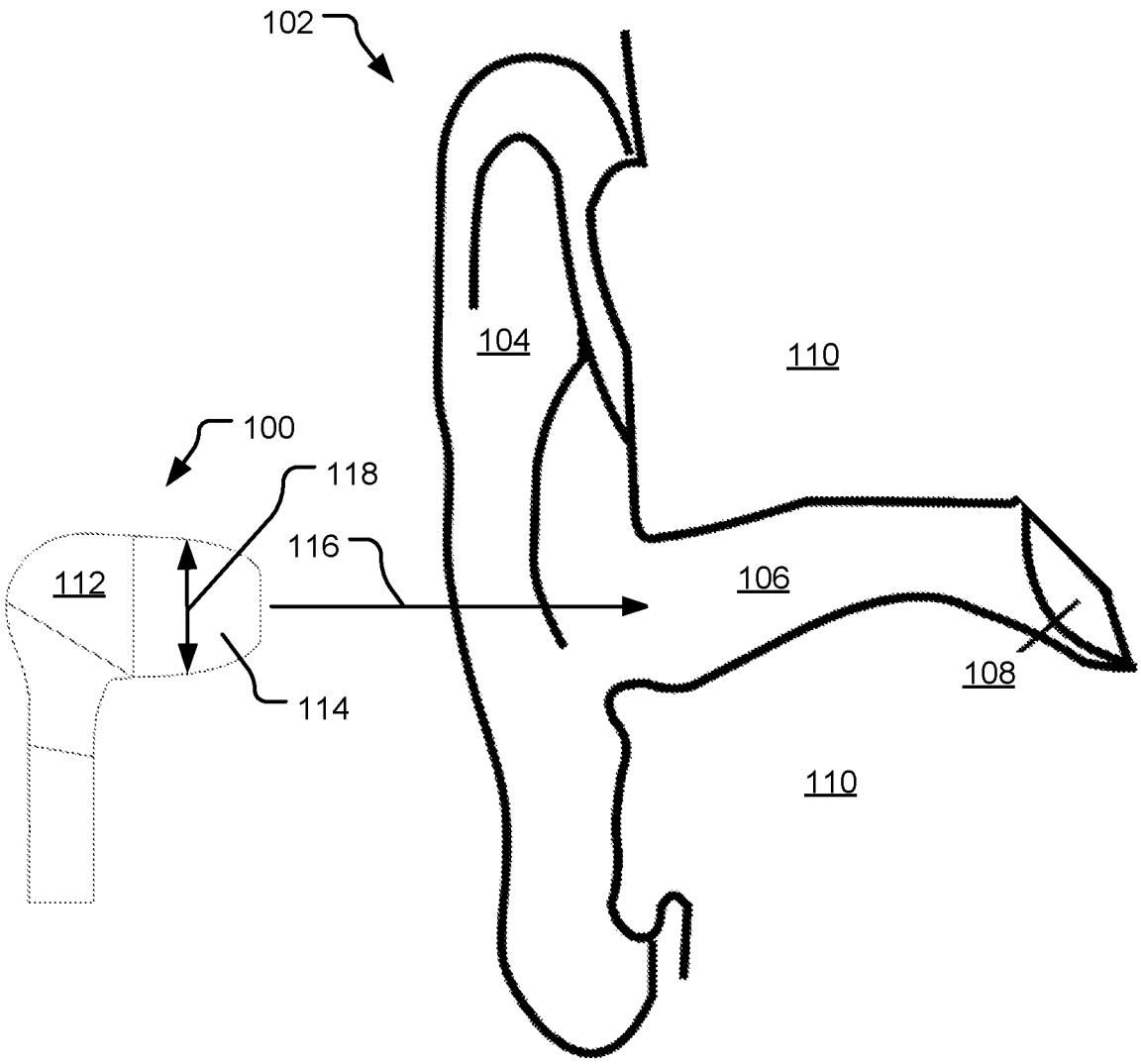
FIG. 1 illustrates an example adjustable in-ear plug to be secured within a user's ear.

FIG. 1 illustrates an example adjustable in-ear plug 100 to be secured within a user's ear 102. The ear 102 is responsible for the user's sense of hearing and is composed of an outer ear (shown), a middle ear (not shown), and an inner ear (also not shown). The user's outer ear includes a pinna 104, an ear canal 106, and an eardrum (or tympanic membrane) 108. The pinna 104 is external to the user's head 110 and is primarily composed of elastic cartilage that aids the user's localization of sound. The pinna 104 is connected to the ear canal 106, which extends into the user's head 110. From the pinna 104, sound waves move into the ear canal 106, which is a sound tube running from the pinna 104 to the eardrum 108, and beyond to the middle ear and inner ear. The eardrum 108 is a thin, generally conical membrane that separates the depicted outer ear from the middle ear. The eardrum 108 transmits incoming sounds from the ear canal 106 to the middle ear and inner ear, where the sounds are converted into a nervous signal interpreted by the user's brain.

The in-ear plug 100 includes a main housing 112 and a resilient membrane tip 114. In various implementations, the main housing 112 may secure and enclose various internal components of the in-ear plug 100 (e.g., an adjustment mechanism, not shown) and serves as a physical interface of the user to insert the in-ear plug 100 into the user's ear canal 106, as illustrated by arrow 116, and remove the in-ear plug 100 from the user's ear canal 106.

The resilient membrane tip 114 is intended to resiliently conform to the user's ear canal 106 when inserted into the user's ear 102. As the size and shape of the ear canal 106 may vary greatly between multiple users, and each user have individual preferences regarding fit that may change over time, the resilient membrane tip 114 is physically adjustable by the user to aid in achieving a desired fit. For example, the in-ear plug 100 may be adjusted independently from a second in-ear plug for a user with substantially different ear canals in each ear. For further example, the user may prefer different seal conditions between the adjustable in-ear plug 100 and the user's ear canal 106 based on a variety of factors (e.g., the user's activity level, a desired sound quality, the duration the user intends to use the adjustable in-ear plug 100, and so on). At least an overall diameter of the resilient membrane tip 114 is adjustable by the user, as illustrated by arrow 118. In various implementations, the resilient membrane tip 114 may be adjustable up to a 1.8 mm or a 2.0 mm change in diameter.

In various implementations, other qualities of the resilient membrane tip 114 may also be adjustable, including but not limited to length, characteristic exterior shape, and resistance to compression (firmness). For example, the resilient membrane tip 114 may have a conical, bulbous, or spherical characteristic shape, which may be adjustable or user-selectable. The resilient membrane tip 114 may also be made of a variety of materials, including but not limited to rubber, silicone, silicone rubber, and other elastomers.

In various implementations, the in-ear plug 100 may be an in-ear monitor (for converting an electrical signal into sound to be played for the user via a small loudspeaker), an earplug (intended to block incoming sound), or a hearing aid (intended to amplify incoming sounds for a user with hearing loss). In-ear monitors, earplugs, and hearing aids are collectively referred to herein as in-ear plugs. While in-ear monitors, earplugs, and hearing aids may include a variety of additional features, each may include adjustment mechanisms as described and illustrated in detail herein.

Figure 2:
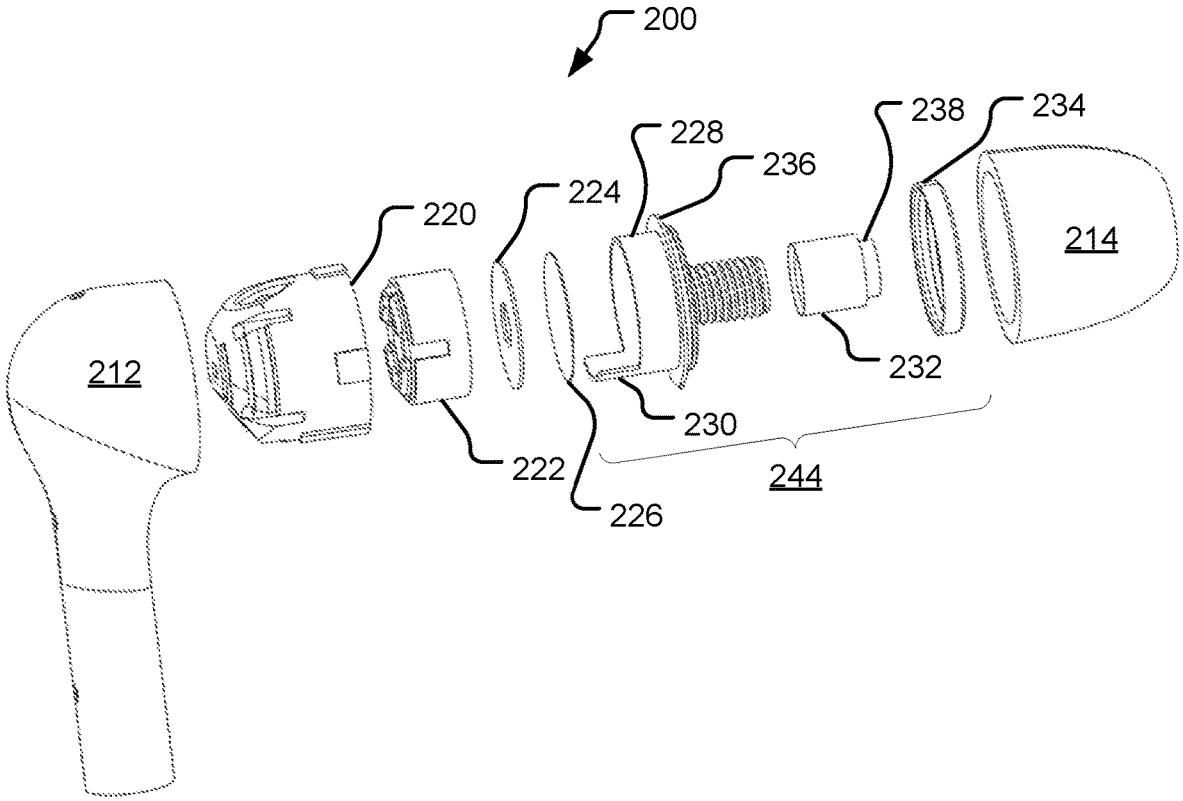
FIG. 2 illustrates an exploded perspective view of an example adjustable in-ear monitor.

FIG. 2 illustrates an exploded perspective view of an example adjustable in-ear monitor 200. The in-ear monitor 200 includes a main housing 212 that secures and encloses various internal components of the in-ear monitor 200. More specifically, the main housing 212 encloses an internal housing 220 that secures a magnetic driver 222 and defines a back cavity (not shown) behind the magnetic driver 222. A voice coil 224 is installed over the magnetic driver 222 and the magnetic driver 222 and the voice coil 224 are sealed within the internal housing 220 by a flexible membrane 226. In combination, the magnetic driver 222 and the voice coil 224 (collectively, a speaker or electroacoustic transducer) convert an input electrical signal into a corresponding sound that is transmitted through the flexible membrane 226 and a threaded center post 228, which may be a sound tube.

When assembled, the threaded center post 228 is locked rotationally with respect to the internal housing 220 via protrusion 230 and the internal housing 220 is locked rotationally with respect to the main housing 212 due to matching interlocking features of the internal housing 220 and the main housing 212. A threaded adjustment collar 232 is screwed concentrically onto the center post 228. A position of the adjustment collar 232 on the center post 228 defines a size and shape profile of resilient membrane tip 214, as described in further detail below.

When assembled, a first internal surface of the resilient membrane tip 214 is attached concentrically to a seat 238 on the adjustment collar 232, while a second internal surface of the resilient membrane tip 214 is attached to adjustment ring 234. The adjustment ring 234 is secured linearly against a stop 236 on the center post 228, while being permitted to rotate with reference to the center post 228. In combination, the center post 228, the adjustment collar 232, and the adjustment ring 234 form an adjustment mechanism 244 for the adjustable in-ear monitor 200. The resilient membrane tip 214 is installed over and covers a portion of the adjustment mechanism 244 for the adjustable in-ear monitor 200. In various implementations, the resilience of the resilient membrane tip 214 resists the threaded adjustment collar 232 being screwed onto the center post 228. The resulting tensile force between the adjustment collar 232 and the center post 228 may cause a locking effect within the screwed connection.

For the adjustable in-ear monitor 200, the center post 228 and the adjustment collar 232 are each a hollow sound tube to permit sound to travel from the voice coil 224 and the magnetic driver 222 through the center post 228 and the adjustment collar 232 and out of the in-ear monitor 200. In implementations that include a similar adjustment mechanism for an earplug, the center post 228 and the adjustment collar 232 may lack a pass through to prevent sound from traveling through the earplug.

In some implementations, one or more components of the adjustment mechanism 244 include protrusions and matching recesses that bias the adjustable in-ear monitor 200 to one of several predefined positions. For example, the user may need to slide the resilient membrane tip 214 away from the main housing 212 to unseat the protrusions from the matching recesses and enable the adjustable in-ear monitor 200 to be adjusted. The user may then slide the resilient membrane tip 214 back toward the main housing 212 to lock the protrusions back into the matching recesses.

In other implementations, the in-ear monitor 200 may incorporate a dial or knob (not shown) that a user manipulates to rotate the adjustment collar 232 with reference to the center post 228. In still other implementations, the in-ear monitor 200 includes a motor (not shown) that selectively drives rotation of the adjustment collar 232 with reference to the center post 228. For example, a user may activate the motor and/or choose a direction of the motor rotation to increase or decrease the outside diameter and/or change the shape of the resilient membrane tip 214 as desired. In further implementations, the in-ear monitor 200 also includes a pressure sensor that drives the motor. For example, a user may indicate that the in-ear monitor 200 has been placed in the user's ear canal, which triggers the motor to rotate the adjustment collar 232 with reference to the center post 228, increasing or decreasing the outside diameter and/or changing the shape of the resilient membrane tip 214, and achieving a desired pressure against the user's ear canal walls. The desired pressure may be preset or set by the user.

Figure 3:
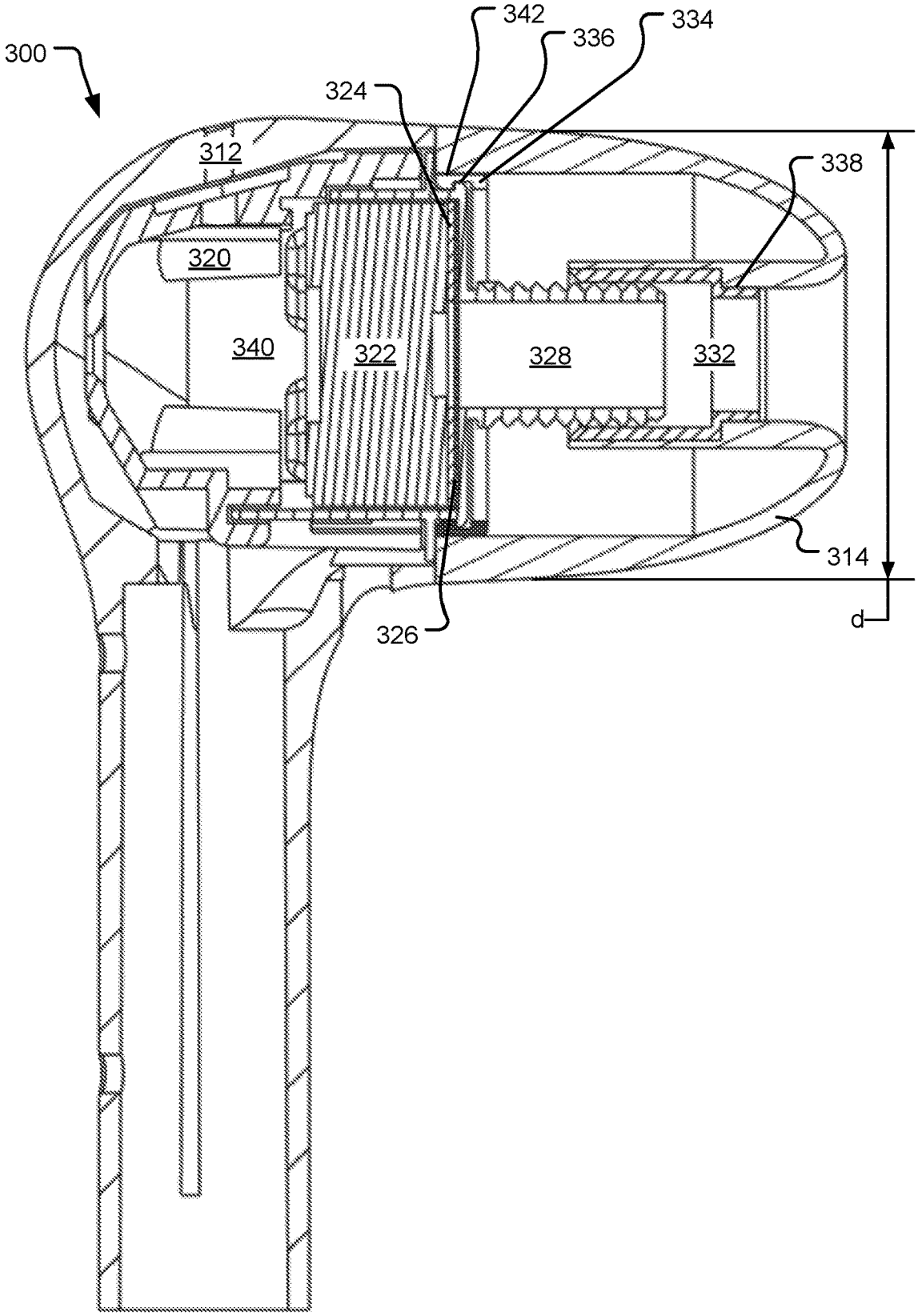
FIG. 3 illustrates a sectional view of the example adjustable in-ear monitor of FIG. 2 in an extended orientation.

FIG. 3 illustrates a sectional view of the example adjustable in-ear monitor 200 of FIG. 2 in an extended orientation. In-ear monitor 300 includes a main housing 312 that secures and encloses various internal components of the in-ear monitor 300. More specifically, the main housing 312 encloses an internal housing 320 that secures a magnetic driver 322 and defines a back cavity 340 behind the magnetic driver 322. A voice coil 324 is installed over the magnetic driver 322. The magnetic driver 322 and the voice coil 324 are sealed within the internal housing 320 by a flexible membrane 326. In combination, the magnetic driver 322 and the voice coil 324 (collectively, a speaker or electroacoustic transducer) converts an input electrical signal into a corresponding sound that is transmitted through the flexible membrane 326 and a threaded center post 328, which may be a sound tube.

A threaded adjustment collar 332 is screwed concentrically onto the center post 328. A position of the adjustment collar 332 on the center post 328 defines a size and shape profile of resilient membrane tip 314, as described in further detail below. When assembled, a portion of the resilient membrane tip 314 is attached concentrically to a seat 338 on the adjustment collar 332, while another portion 342 of the resilient membrane tip 314 is attached to adjustment ring 334. The adjustment ring 334 is secured linearly against a stop 336 on the center post 328, while being permitted to rotate with reference to the center post 328. In combination, the center post 328, the adjustment collar 332, and the adjustment ring 334 form an adjustment mechanism for the adjustable in-ear monitor 300. The resilient membrane tip 314 is installed over and covers a portion of the adjustment mechanism for the adjustable in-ear monitor 300.

The adjustment collar 332 is illustrated in an extended orientation, which minimizes diameter (d) of the resilient membrane tip 314 and yields a characteristically bullet shape of the resilient membrane tip 314. To adjust the resilient membrane tip 314, a user may grasp the main housing 312 and the resilient membrane tip 314, each in a different hand and screw the adjustment collar 332 further onto the center post 328 by twisting the resilient membrane tip 314 with reference to the main housing 312. Screwing the adjustment collar 332 onto the center post 328 pulls a center portion of the resilient membrane tip 314 inward, which influences the diameter (d) of the resilient membrane tip 314, as well as its characteristic shape, as described further with reference to FIG. 4 below.

Figure 4:
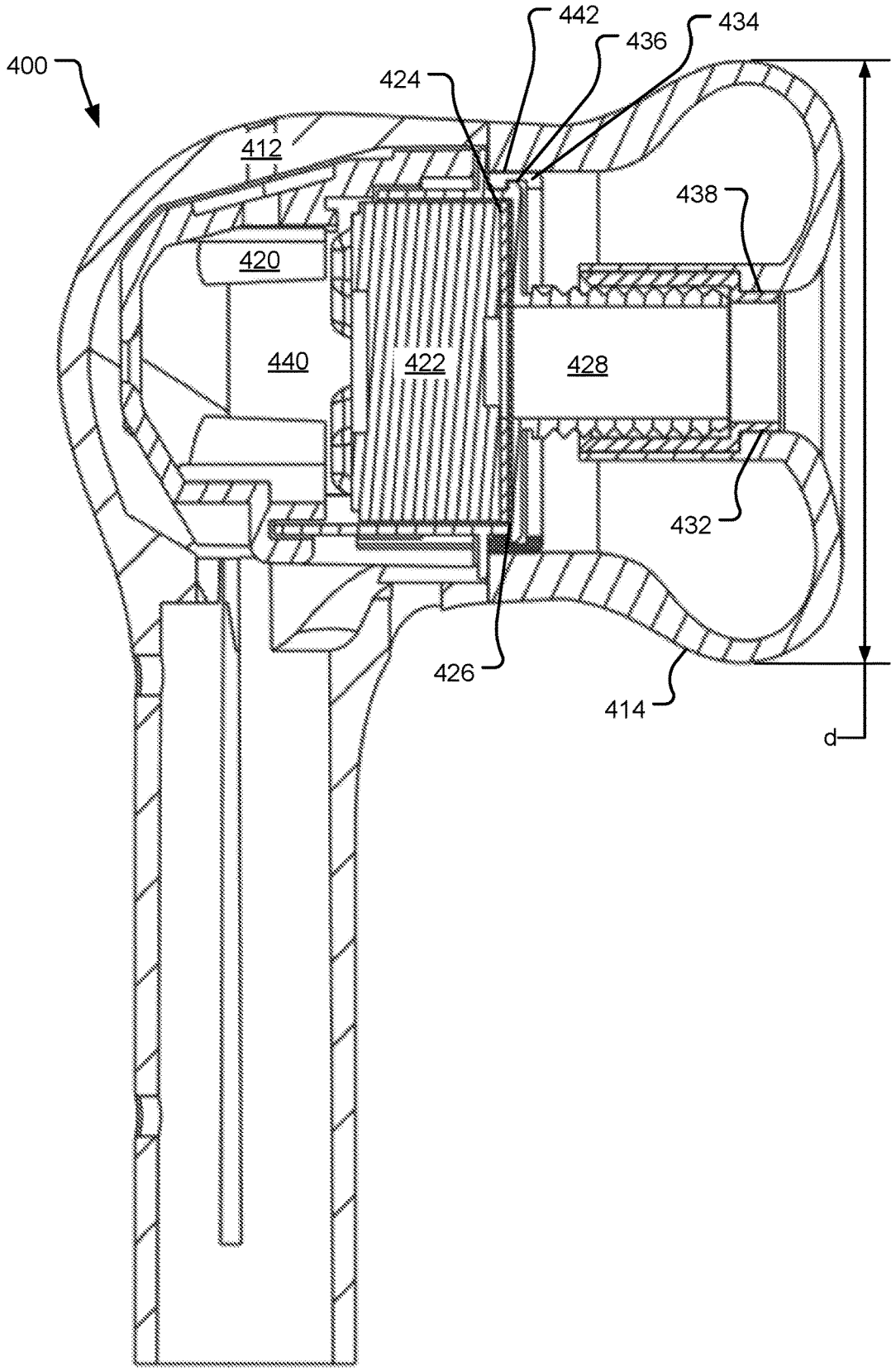
FIG. 4 illustrates a sectional view of the example adjustable in-ear monitor of FIG. 2 in a retracted orientation.

FIG. 4 illustrates a sectional view of the example adjustable in-ear monitor 200 of FIG. 2 in a retracted orientation. In-ear monitor 400 includes a main housing 412 that secures and encloses various internal components of the in-ear monitor 400. More specifically, the main housing 412 encloses an internal housing 420 that secures a magnetic driver 422 and defines a back cavity 440 behind the magnetic driver 422. A voice coil 424 is installed over the magnetic driver 422. The magnetic driver 422 and the voice coil 424 are sealed within the internal housing 420 by a flexible membrane 426. In combination, the magnetic driver 422 and the voice coil 424 (collectively, a speaker or electroacoustic transducer) convert an input electrical signal into a corresponding sound that is transmitted through the flexible membrane 426 and a threaded center post 428, which may be a sound tube.

A threaded adjustment collar 432 is screwed concentrically onto the center post 428. A position of the adjustment collar 432 on the center post 428 defines a size and shape profile of resilient membrane tip 414, as described in further detail below. When assembled, a portion of the resilient membrane tip 414 is attached concentrically to a seat 438 on the adjustment collar 432, while another portion 442 of the resilient membrane tip 414 is attached to adjustment ring 434. The adjustment ring 434 is secured linearly against a stop 436 on the center post 428, while being permitted to rotate with reference to the center post 428. In combination, the center post 428, the adjustment collar 432, and the adjustment ring 434 form an adjustment mechanism for the adjustable in-ear monitor 400. The resilient membrane tip 414 is installed over and covers a portion of the adjustment mechanism for the adjustable in-ear monitor 400.

The adjustment collar 432 is illustrated in a retracted orientation, which maximizes diameter (d) of the resilient membrane tip 414 and yields a generally bulbous shape of the resilient membrane tip 414. To adjust the resilient membrane tip 414, a user may grasp the main housing 412 and the resilient membrane tip 414, each in a different hand and screw the adjustment collar 432 away from the center post 428 by twisting the resilient membrane tip 414 with reference to the main housing 412. Screwing the adjustment collar 432 away from the center post 428 pushes a center portion of the resilient membrane tip 414 outward, which influences the diameter (d) of the resilient membrane tip 414, as well as its characteristic shape and overall length, returning the resilient membrane tip 414 gradually to a shape that may be similar to that depicted and described in detail with reference to FIG. 3. In some implementations, the cross-sectional profile of the resilient membrane tip 414 is pre-defined to achieve a desired shape of the resilient membrane tip 414 in the retracted orientation.

Figure 5:
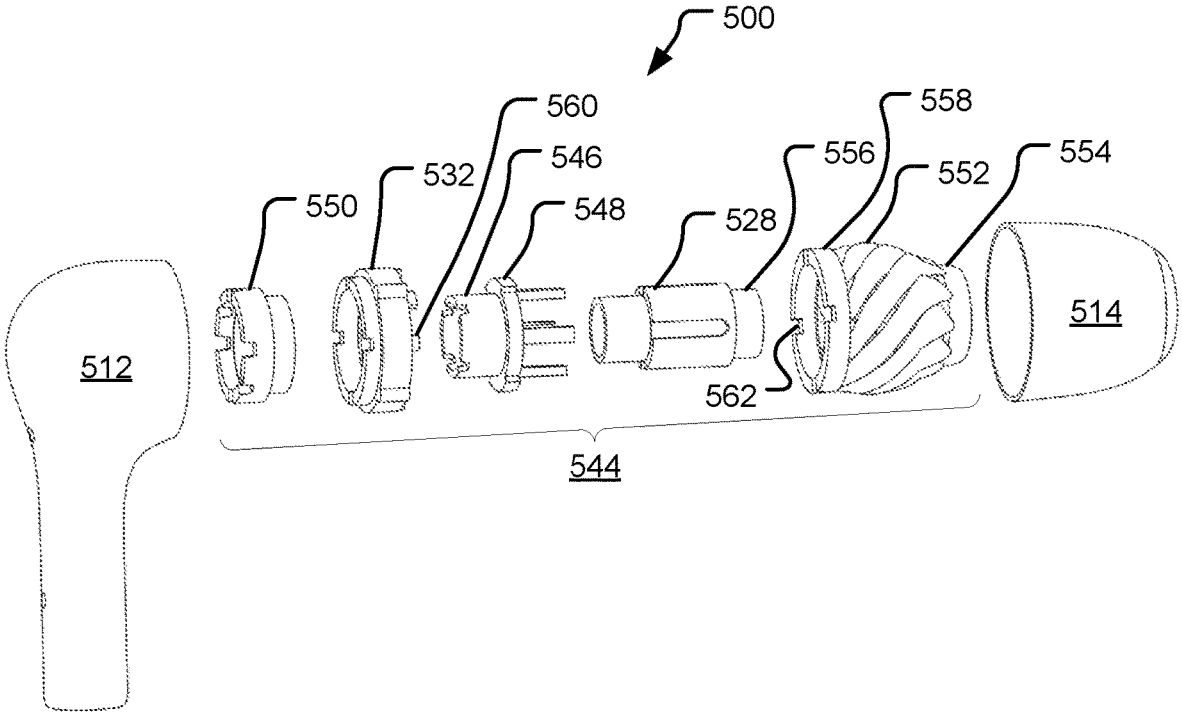
FIG. 5 illustrates an exploded perspective view of another example adjustable in-ear monitor.

FIG. 5 illustrates an exploded perspective view of another example adjustable in-ear monitor 500. The in-ear monitor 500 includes a main housing 512 that secures and encloses various internal components of the in-ear monitor 500. More specifically, the main housing 512 may enclose an internal housing that secures a magnetic driver and defines a back cavity behind the magnetic driver. A voice coil may be installed over the magnetic driver and the magnetic driver and the voice coil may be sealed within the internal housing by a flexible membrane. In combination, the magnetic driver and the voice coil (collectively, a speaker or electroacoustic transducer) may convert an input electrical signal into a corresponding sound that is transmitted through the flexible membrane and adjustment mechanism 544, which may form a sound tube. While not depicted in FIG. 5, the internal housing, magnetic driver, voice coil, and flexible membrane, for the in-ear monitor 500 may be as shown and described in detail above with regard to FIGS. 2-4.

The adjustment mechanism 544 includes a center post 528, which is interfaced with and rotationally locked to lock collar 546. The lock collar 546 is in turn interfaced with adjustment collar 532. A pair of lobes (e.g., lobe 548) on the lock collar 546 interface with associated recesses (not shown) in the adjustment collar 532 to permit the adjustment collar 532 to rotate up to approximately 90 degrees with reference to the lock collar 546 (and the center post 528). In other implementations, the adjustment collar 532 may be permitted to rotate up to greater than or less than 90 degrees. A cap 550 is interfaced with the adjustment collar 532 and a screw (not shown) may extend through each of the cap 550, the adjustment collar 532, the lock collar 546, and the center post 528 to hold the adjustment mechanism 544 together while permitting rotation of the adjustment collar 532 with reference to the lock collar 546 (and the center post 528).

A first end 554 of radial expander 552 is fixedly attached to seat 556 on the center post 528. A second end 558 of the radial expander 552 is fixedly attached to the adjustment collar 532 by interfacing protrusions (e.g., protrusion 560) on the adjustment collar 532 with matching recesses (e.g., recess 562) on the radial expander 552. In the resulting assembled adjustment mechanism 544, rotation of the adjustment collar 532 in a first direction with reference to the lock collar 546 (and the center post 528) causes the radial expander 552 to expand outward, as described in detail with regard to FIG. 8 below. Similarly, rotation of the adjustment collar 532 in a second opposite direction causes the radial expander 552 to retract inward.

The position of the adjustment collar 532 with reference to the lock collar 546 and the center post 528 defines a size and shape profile of the radial expander 552, which in turn defines a size and shape profile of resilient membrane tip 514, which is stretched over the radial expander 552 and readily conforms to the shape of the radial expander 552. The resilient membrane tip 514 is attached to the first end 554 of the radial expander 552 or the seat 556 on the center post 528. This permits the resilient membrane tip 514 to remain in place over the radial expander 552, while permitting the resilient membrane tip 514 to change size and shape according to corresponding changes in size and shape of the radial expander 552.

For the adjustable in-ear monitor 500, at least the center post 528 and in some implementations, the cap 550, the adjustment collar 532, and the lock collar 546 create a hollow sound tube to permit sound to travel from the voice coil and magnetic driver through the sound tube and out of the in-ear monitor 500. In implementations that include a similar adjustment mechanism for an earplug, at least the center post 528 and in some implementations, the cap 550, the adjustment collar 532, and the lock collar 546 may lack a pass through to prevent sound from traveling through the earplug.

In some implementations, one or more components of the adjustment mechanism 544 include protrusions and matching recesses that bias the adjustable in-ear monitor 500 to one of several predefined positions. For example, the user may need to slide the resilient membrane tip 514 away from the main housing 512 to unseat the protrusions from the matching recesses and enable the adjustable in-ear monitor 500 to be adjusted. The user may then slide the resilient membrane tip 514 back toward the main housing 512 to lock the protrusions back into the matching recesses.

In other implementations, the in-ear monitor 500 may incorporate a dial or knob (not shown) that a user manipulates to rotate the adjustment collar 532 with reference to the center post 528. In still other implementations, the in-ear monitor 500 includes a motor (not shown) that selectively drives rotation of the adjustment collar 532 with reference to the center post 528. For example, a user may activate the motor and/or choose a direction of the motor rotation to increase or decrease the outside diameter and/or change the shape of the resilient membrane tip 514 as desired. In further implementations, the in-ear monitor 500 also includes a pressure sensor that drives the motor. For example, a user may indicate that the in-ear monitor 500 has been placed in the user's ear canal, which triggers the motor to rotate the adjustment collar 532 with reference to the center post 528, increase or decrease the outside diameter and/or change the shape of the resilient membrane tip 514, and achieve a desired pressure against the user's ear canal walls. The desired pressure may be preset or user-adjustable.

Figure 6:
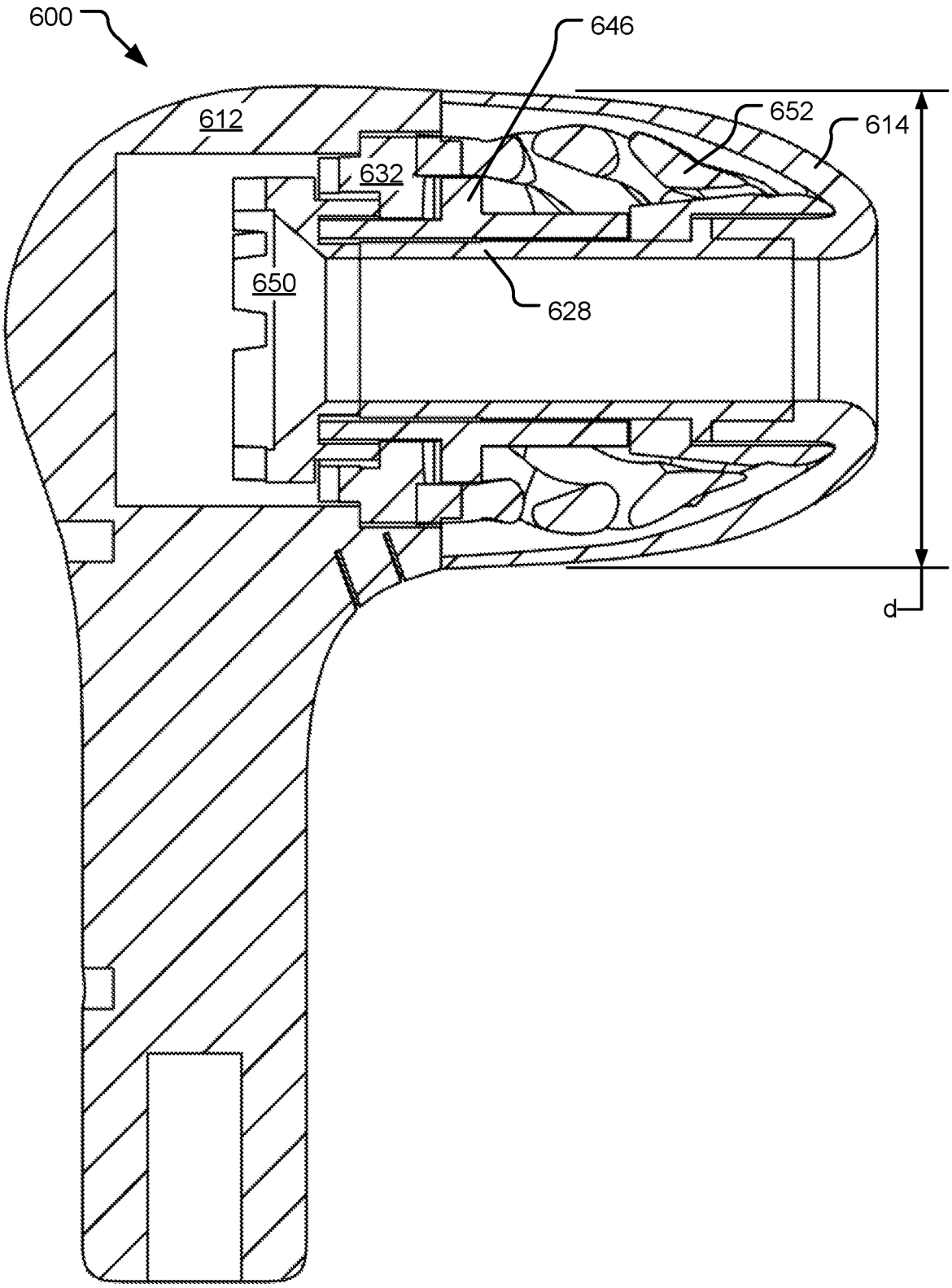
FIG. 6 illustrates a sectional view of the example adjustable in-ear monitor of FIG. 5 in a retracted orientation.

FIG. 6 illustrates a sectional view of the example adjustable in-ear monitor 500 of FIG. 5 in a retracted orientation. In-ear monitor 600 includes a main housing 612 that secures and encloses various internal components of the in-ear monitor 600. More specifically, the main housing 612 may enclose an internal housing that secures a magnetic driver and defines a back cavity behind the magnetic driver. A voice coil may be installed over the magnetic driver and the magnetic driver and the voice coil may be sealed within the internal housing by a flexible membrane. In combination, the magnetic driver and the voice coil (collectively, a speaker or electroacoustic transducer) may convert an input electrical signal into a corresponding sound that is transmitted through the flexible membrane and other components of the in-ear monitor 600, which may form a sound tube. While not depicted in FIG. 6, the internal housing, magnetic driver, voice coil, and flexible membrane for the in-ear monitor 600 may be as shown and described in detail above with regard to FIGS. 2-4.

An adjustment mechanism for the in-ear monitor 600 includes a center post 628, which is interfaced with and rotationally locked to lock collar 646. The lock collar 646 is in turn interfaced with adjustment collar 632. A pair of lobes on the lock collar 646 interface with associated recesses in the adjustment collar 632 to permit the adjustment collar 632 to rotate up to approximately 90 degrees with reference to the lock collar 646 (and the center post 628). A cap 650 is interfaced with the adjustment collar 632 and a screw may extend through each of the cap 650, the adjustment collar 632, the lock collar 646, and the center post 628 to hold the adjustment mechanism together while permitting rotation of the adjustment collar 632 with reference to the lock collar 646 (and the center post 628).

A first end of radial expander 652 is fixedly attached to a seat on the center post 628. A second end of the radial expander 652 is fixedly attached to the adjustment collar 632 by interfacing protrusions on the adjustment collar 632 with matching recesses on the radial expander 652. In the resulting assembled adjustment mechanism, rotation of the adjustment collar 632 in a first direction with reference to the lock collar 646 (and the center post 628) causes the radial expander 652 to expand outward, as described in detail with regard to FIG. 8 below. Similarly, rotation of the adjustment collar 632 in a second opposite direction with reference to the lock collar 646 (and the center post 628) causes the radial expander 652 to retract inward.

The position of the adjustment collar 632 with reference to the lock collar 646 and the center post 628 defines a size and shape profile of the radial expander 652, which in turn defines a size and shape profile of resilient membrane tip 614, which is stretched over the radial expander 652 and readily conforms to the shape of the radial expander 652. The resilient membrane tip 614 is attached to the radial expander 652 or the center post 628 to permit the resilient membrane tip 614 to remain in place over the radial expander 652, while permitting the resilient membrane tip 614 to change size and shape according to corresponding changes in size and shape of the radial expander 652.

The radial expander 652 is illustrated in a retracted orientation, which minimizes diameter (d) of the resilient membrane tip 614 and yields a characteristically bullet shape of the resilient membrane tip 614. To adjust the resilient membrane tip 614, a user may grasp the main housing 612 and the resilient membrane tip 614, each in a different hand and twist the resilient membrane tip 614 with reference to the main housing 612. The twisting action forces the radial expander 652 outward, which influences the diameter (d) of the resilient membrane tip 614, as well as its characteristic shape, as described further with reference to FIGS. 7 and 8 below.

Figure 7:
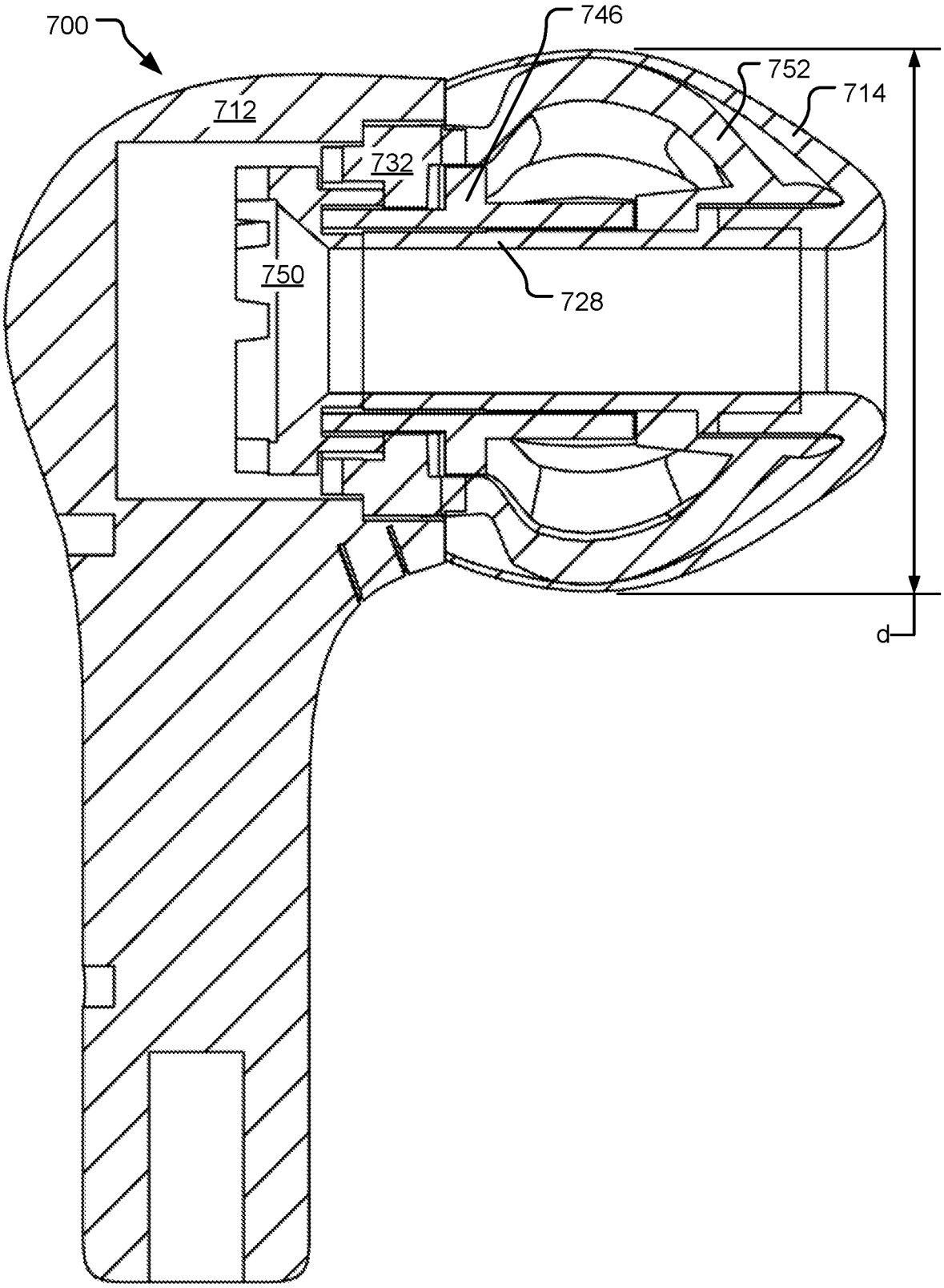
FIG. 7 illustrates a sectional view of the example adjustable in-ear monitor of FIG. 5 in an expanded orientation.

FIG. 7 illustrates a sectional view of the example adjustable in-ear monitor 500 of FIG. 5 in an expanded orientation. In-ear monitor 700 includes a main housing 712 that secures and encloses various internal components of the in-ear monitor 700. More specifically, the main housing 712 may enclose an internal housing that secures a magnetic driver and defines a back cavity behind the magnetic driver. A voice coil may be installed over the magnetic driver and the magnetic driver and the voice coil may be sealed within the internal housing by a flexible membrane. In combination, the magnetic driver and the voice coil (collectively, a speaker or electroacoustic transducer) may convert an input electrical signal into a corresponding sound that is transmitted through the flexible membrane and other components of the in-ear monitor 700, which may form a sound tube. While not depicted in FIG. 7, the internal housing, magnetic driver, voice coil, and flexible membrane for the in-ear monitor 700 may be as shown and described in detail above with regard to FIGS. 2-4.

An adjustment mechanism for the in-ear monitor 700 includes a center post 728, which is interfaced with and rotationally locked to lock collar 746. The lock collar 746 is in turn interfaced with adjustment collar 732. A pair of lobes on the lock collar 746 interface with associated recesses in the adjustment collar 732 to permit the adjustment collar 732 to rotate up to approximately 90 degrees with reference to the lock collar 746 (and the center post 728). A cap 750 is interfaced with the adjustment collar 732 and a screw may extend through each of the cap 750, the adjustment collar 732, the lock collar 746, and the center post 728 to hold the adjustment mechanism together while permitting rotation of the adjustment collar 732 with reference to the lock collar 746 (and the center post 728).

A first end of radial expander 752 is fixedly attached to a seat on the center post 728. A second end of the radial expander 752 is fixedly attached to the adjustment collar 732 by interfacing protrusions on the adjustment collar 732 with matching recesses on the radial expander 752. In the resulting assembled adjustment mechanism, rotation of the adjustment collar 732 in a first direction with reference to the lock collar 746 (and the center post 728) causes the radial expander 752 to expand outward, as described in detail with regard to FIG. 8 below. Similarly, rotation of the adjustment collar 732 in a second opposite direction causes the radial expander 752 to retract inward.

The position of the adjustment collar 732 with reference to the lock collar 746 and the center post 728 defines a size and shape profile of the radial expander 752, which in turn defines a size and shape profile of resilient membrane tip 714, which is stretched over the radial expander 752 and readily conforms to the shape of the radial expander 752. The resilient membrane tip 714 is attached to the radial expander 752 or the center post 728 to permit the resilient membrane tip 714 to remain in place over the radial expander 752, while permitting the resilient membrane tip 714 to change size and shape according to corresponding changes in size and shape of the radial expander 752.

The radial expander 752 is illustrated in an expanded orientation, which maximizes diameter (d) of the resilient membrane tip 714 and yields a characteristically rounded or bulbous shape of the resilient membrane tip 714. To adjust the resilient membrane tip 714, a user may grasp the main housing 712 and the resilient membrane tip 714, each in a different hand and twist the resilient membrane tip 714 with reference to the main housing 712. The twisting action forces the radial expander 752 inward, which influences the diameter (d) of the resilient membrane tip 714, as well as its characteristic shape, returning the resilient membrane tip 714 gradually to a shape that may be similar to that depicted and described in detail with reference to FIG. 6 above. In some implementations, the cross-sectional profile of the resilient membrane tip 714 is pre-defined to achieve a desired shape of the resilient membrane tip 714 in the expanded orientation.

Figure 8:
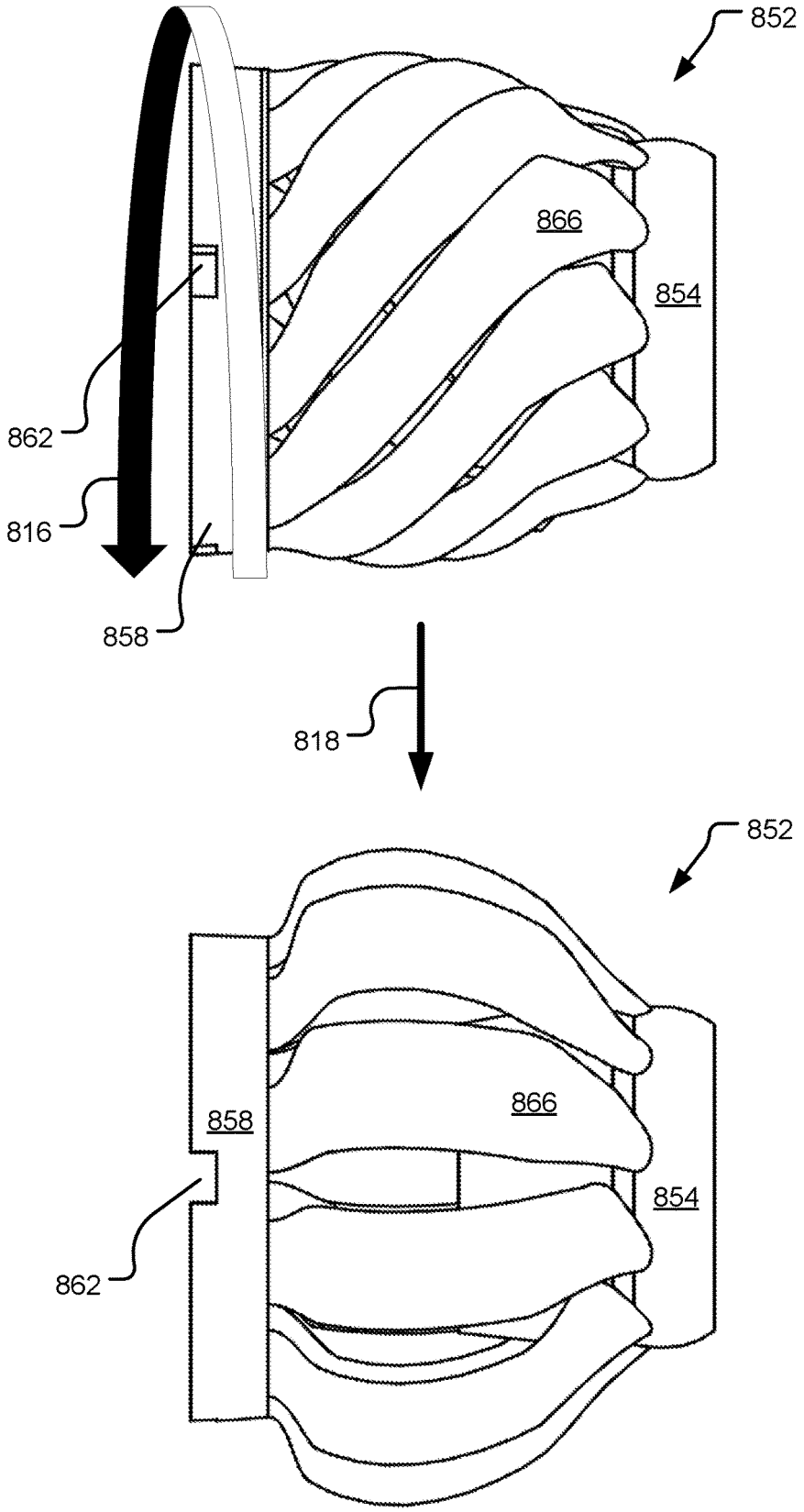
FIG. 8 illustrates an example radial expander for an adjustable in-ear monitor in a retracted orientation and an expanded orientation.

FIG. 8 illustrates an example radial expander 852 for an adjustable in-ear monitor in a retracted orientation and an expanded orientation. The radial expander 852 is a component of some adjustment mechanisms for adjustable in-ear monitors disclosed herein. The radial expander 852 functions by selectively expanding and retracting in response to twisting a first end 854 with reference to a second end 858 of the radial expander 852.

Specifically, the first end 854 of the radial expander 852 may be fixedly attached to a seat on a center post (not shown) within an adjustment mechanism. The second end 858 of the radial expander 852 may be fixedly attached to an adjustment collar (not shown) within the adjustment mechanism by interfacing protrusions on the adjustment collar with matching recesses (e.g., recess 862) on the radial expander 852. In the resulting assembled adjustment mechanism, rotation of the adjustment collar in a first direction, as illustrated by arrow 816 causes each of an array of blades (e.g., blade 866) that are arranged in a stacked spiral formation to unwind and expand outward. Rotation of the adjustment collar in an opposite second direction causes the array of blades to return to the stacked spiral formation. As the first end 854 and the second end 858 of the radial expander 852 remain a fixed distance from one another, the blades are forced outward when unwound.

The progression of the radial expander 852 from a fully retracted orientation to a fully expanded orientation is illustrated by the two images of the radial expander 852 in FIG. 8 with arrow 818 illustrating the change over time. A similar progression from a fully expanded orientation to a fully retracted orientation may be illustrated by the two images of the radial expander 852 in FIG. 8 with a reverse arrow illustrating the change over time.

The radial expander 852 may include any number of blades (e.g., 6-20) with variations in their size and shape from that depicted in FIG. 8. Further, the radial expander 852 may be designed to produce a full stroke from a fully retracted orientation to a fully expanded orientation within a variety of angular rotations. In some implementations, a full stroke occurs within a 90-degree rotation of the first end 854 with reference to the second end 858. In other implementations, the full stroke may occur in as little as 45-degrees or as many as multiple 360-degree rotations of the first end 854 with reference to the second end 858. Still further, the radial expander 852 may be made of a variety of materials, including but not limited to metal wires, rubber, silicone, silicone rubber, other elastomers, and composites thereof. In implementations where the radial expander 852 is made of a resiliently deflectable material, it may be constructed with a bias to return to either the fully retracted orientation, the fully expanded orientation, or a predefined orientation therebetween.

Figure 9:
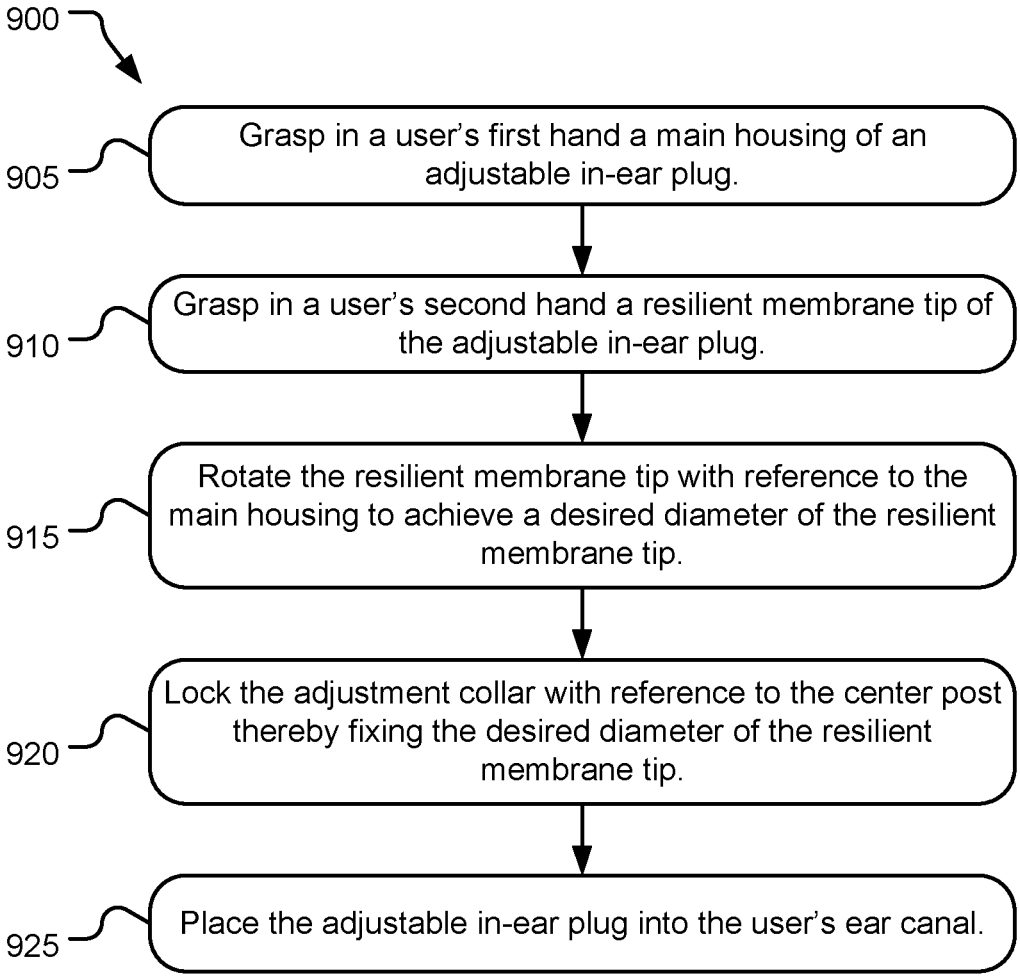
FIG. 9 illustrates example operations for using an adjustable in-ear plug.

FIG. 9 illustrates example operations 900 for using an adjustable in-ear plug. In a first grasping operation 905, a user grasps a main housing of an adjustable in-ear plug with the user's first hand. Due to the small size, the first grasping operation 905 may often be performed by two or three of the user's fingers on the user's first hand. In a second grasping operation 910, the user grasps a resilient membrane tip of the adjustable in-ear plug with the user's second hand. Similar to first grasping operation 905, the second grasping operation 910 may often be performed by two or three of the user's fingers on the user's second hand. In implementations where the adjustable in-ear plug is being adjusted while placed within the user's ear canal, the second grasping operation 910 is achieved by the user's ear canal gripping the resilient membrane tip rather than the user's second hand.

In a rotation operation 915, the user rotates the resilient membrane tip with reference to the main housing to achieve a desired diameter of the resilient membrane tip. The adjustable in-ear plug includes an adjustment mechanism, which in turn includes a center post and an adjustment collar concentric with the center post. The main housing is fixed to the center post while the resilient membrane tip is fixed to the adjustment collar. As a result, the user's rotation of the resilient membrane tip with reference to the main housing causes the adjustment collar to rotate with reference to the center post within the adjustment mechanism. In various implementations, the adjustment mechanism may include additional components (e.g., a radial expander).

In implementations where the adjustment collar is threaded onto the center post, such rotation either pulls a central portion of the resilient membrane tip inward, forcing the resilient membrane tip outward, thereby increasing its outside diameter and changing its overall shape (see e.g., FIGS. 3 and 4, described in detail above). In implementations that include a radial expander between the adjustment collar and the center post, such rotation forces an array of blades on the radial expander outward, which in turn forces the resilient membrane tip outward as well (see e.g., FIGS. 6 and 7, described in detail above). Other implementations may have different or additional components within the adjustment mechanism to selectively change the size and shape of the resilient membrane tip in response to the user's rotation of the resilient membrane tip with reference to the main housing.

While the rotation operation 915 is described in detail above in the context of increasing the diameter of the resilient membrane tip, rotation of the resilient membrane tip with reference to the main housing in an opposite direction generally decreases the diameter of the resilient membrane tip. As a result, the user performing the rotation operation 915 may increase and decrease the diameter (and change the characteristic shape) of the resilient membrane tip iteratively to achieve the exact desired size and shape of the resilient membrane tip.

In a locking operation 920, the user locks the adjustment collar with reference to the center post thereby fixing the desired diameter and shape of the resilient membrane tip in place. By locking the desired diameter and shape of the resilient membrane tip, the user may handle the adjustable in-ear plug without risking an inadvertent change to the desired diameter and shape, for example, when the user places the adjustable in-ear plug within the user's ear canal (see placing operation 925 below). In some implementations, one or more components of the adjustment mechanism include protrusions and matching recesses that bias the adjustable in-ear plug to one of several predefined positions. For example, the user may need to slide the resilient membrane tip away from the main housing to unseat the protrusions from the matching recesses and enable the adjustable in-ear plug to be adjusted per the rotating operation 915. The user may then slide the resilient membrane tip back toward the main housing to lock the protrusions back into the matching recesses.

In a placing operation 925, the user places the adjustable in-ear plug into the user's ear canal. In various implementations, the user may iteratively repeat operations 900 to adjust the resilient membrane tip, test fitment within the user's ear canal, and then readjust resilient membrane tip to achieve the user's desired fitment.

The operations making up the embodiments of the invention described herein may be referred to variously as operations, steps, objects, or modules. Furthermore, the operations may be performed in any order, adding or omitting operations as desired, unless explicitly claimed otherwise or a specific order is inherently necessitated by the claim language.

An example adjustable in-ear plug according to the presently disclosed technology comprises an adjustment mechanism including a center post and an adjustment collar concentric with the center post and a resilient membrane tip also concentric with the center post and covering a portion of the adjustment mechanism. Rotation of the adjustment collar with reference to the center post changes an outside diameter of the resilient membrane tip.

In another example adjustable in-ear plug according to the presently disclosed technology, the adjustment collar has a first end threaded onto the center post and a second end attached to a first end of the resilient membrane tip. The adjustment mechanism further includes an adjustment ring concentrically oriented around the center post, rotatable with reference to the center post, and fixed linearly along the center post. A second end of the resilient membrane tip is attached to the adjustment ring.

In another example adjustable in-ear plug according to the presently disclosed technology, rotation of the adjustment collar in a first direction causes an overall length of the adjustable in-ear plug to decrease and the resilient membrane tip to compress and increase in diameter. Rotation of the adjustment collar in an opposite direction causes the overall length of the adjustable in-ear plug to increase and the resilient membrane tip to stretch and decrease in diameter.

In another example adjustable in-ear plug according to the presently disclosed technology, the adjustment mechanism further includes a radial expander concentric with the center post having a first end fixed to the adjustment collar and a second end fixed to a distal end of the center post. The resilient membrane tip is also fixed to the distal end of the center post.

In another example adjustable in-ear plug according to the presently disclosed technology, rotation of the adjustment collar in a first direction causes the radial expander to expand outward against the resilient membrane tip thereby increasing the outside diameter of the resilient membrane tip. Rotation of the adjustment collar in an opposite direction causes the radial expander to retract inward thereby decreasing the outside diameter of the resilient membrane tip.

In another example adjustable in-ear plug according to the presently disclosed technology, a full stroke of the adjustment mechanism occurs in multiple 360-degree rotations of the adjustment collar with reference to the center post.

In another example adjustable in-ear plug according to the presently disclosed technology, a full stroke of the adjustment mechanism occurs in less than a 360-degree rotation of the adjustment collar with reference to the center post.

Another example adjustable in-ear plug according to the presently disclosed technology further comprises a speaker. The center post and the adjustment collar are each hollow sound tubes to transmit sound from the speaker to a user's ear drum.

In another example adjustable in-ear plug according to the presently disclosed technology, rotation of the adjustment collar with reference to the center post in a first direction increases the outside diameter of the resilient membrane tip.

Rotation of the adjustment collar with reference to the center post in an opposite direction decreases the outside diameter of the resilient membrane tip.

In another example adjustable in-ear plug according to the presently disclosed technology, one or both of the center post and the adjustment collar includes a locking mechanism to selectively secure a radial position of the adjustment collar with reference to the center post.

In another example adjustable in-ear plug according to the presently disclosed technology, rotation of the adjustment collar with reference to the center post further changes a characteristic shape of the resilient membrane tip.

In another example adjustable in-ear plug according to the presently disclosed technology, rotation of the adjustment collar with reference to the center post is driven manually by a user.

In another example adjustable in-ear plug according to the presently disclosed technology, rotation of the adjustment collar with reference to the center post is driven by a motor.

In another example adjustable in-ear plug according to the presently disclosed technology, the adjustable in-ear plug is one of an earplug, in-ear monitor, and a hearing aid.

An example method of using an adjustable in-ear plug according to the presently disclosed technology comprises grasping in a user's first hand a main housing of the adjustable in-ear plug, the main housing in fixed relation to a center post. The method further comprises grasping in the user's second hand a resilient membrane tip of the adjustable in-ear plug, the resilient membrane tip in fixed relation to an adjustment collar concentric with the center post, the resilient membrane tip covering a portion of an adjustment mechanism that includes the center post and the adjustment collar. The method still further comprises rotating the resilient membrane tip with reference to the main housing, which in turn rotates the adjustment collar with reference to the center post thereby changing an outside diameter of the resilient membrane tip.

Another example method of using an adjustable in-ear plug according to the presently disclosed technology further comprises locking the adjustment collar with reference to the center post thereby fixing the outside diameter of the resilient membrane tip.

Another example method of using an adjustable in-ear plug according to the presently disclosed technology further comprises placing the adjustable in-ear plug into the user's ear canal after rotating the resilient membrane tip with reference to the main housing.

In another example method of using an adjustable in-ear plug according to the presently disclosed technology, rotation of the adjustment collar with reference to the center post further changes a characteristic shape of the resilient membrane tip.

In another example method of using an adjustable in-ear plug according to the presently disclosed technology, the adjustable in-ear plug is one of an earplug, in-ear monitor, and a hearing aid.

An example adjustable in-ear monitor according to the presently disclosed technology comprises a sound tube having a threaded end, an adjustment tube having a threaded end, the adjustment tube concentric with the sound tube, and the threaded end of the adjustment tube screwed onto the threaded end of the sound tube, a resilient membrane tip concentric with the sound tube and covering the adjustment tube, the resilient membrane tip having a first end fixed to the adjustment tube, and an adjustment ring concentrically oriented around the sound tube, rotatable with reference to the sound tube, and fixed linearly along the sound tube. A second end of the resilient membrane tip is attached to the adjustment ring, and rotation of the adjustment tube with reference to the sound tube changes an outside diameter of the resilient membrane tip.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. An adjustable in-ear plug comprising:

an adjustment mechanism including:

a center post;

an adjustment collar concentric with and screwed onto the center post; and an adjustment ring concentrically oriented around the center post, rotatable with reference to the center post, and fixed linearly along the center post; and a resilient membrane tip having a first end fixedly attached to the adjustment collar and a second end fixedly attached to the adjustment ring, the resilient membrane tip also concentric with the center post and covering a portion of the adjustment mechanism, wherein rotation of the adjustment ring, resilient membrane tip, and adjustment collar with reference to the center post pulls a center portion of the resilient membrane tip inward, thus changing an outside diameter of the resilient membrane tip.

2. The adjustable in-ear plug of claim 1, wherein rotation of the adjustment collar in a first direction causes an overall length of the adjustable in-ear plug to decrease and the resilient membrane tip to compress and increase in diameter, while rotation of the adjustment collar in an opposite direction causes the overall length of the adjustable in-ear plug to increase and the resilient membrane tip to stretch and decrease in diameter.

3. The adjustable in-ear plug of claim 1, wherein the adjustment mechanism further includes:

a radial expander concentric with the center post having a first end fixed to the adjustment collar and a second end fixed to a distal end of the center post, wherein the resilient membrane tip is also fixed to the distal end of the center post.

4. The adjustable in-ear plug of claim 3, wherein rotation of the adjustment collar in a first direction causes the radial expander to expand outward against the resilient membrane tip thereby increasing the outside diameter of the resilient membrane tip, while rotation of the adjustment collar in an opposite direction causes the radial expander to retract inward thereby decreasing the outside diameter of the resilient membrane tip.

5. The adjustable in-ear plug of claim 1, wherein a full stroke of the adjustment mechanism occurs in multiple 360-degree rotations of the adjustment collar with reference to the center post.

6. The adjustable in-ear plug of claim 1, wherein a full stroke of the adjustment mechanism occurs in less than a 360-degree rotation of the adjustment collar with reference to the center post.

7. The adjustable in-ear plug of claim 1, further comprising:

a speaker, wherein the center post and the adjustment collar are each hollow sound tubes to transmit sound from the speaker to a user's ear drum.

8. The adjustable in-ear plug of claim 1, wherein rotation of the adjustment collar with reference to the center post in a first direction increases the outside diameter of the resilient membrane tip, while rotation of the adjustment collar with reference to the center post in an opposite direction decreases the outside diameter of the resilient membrane tip.

9. The adjustable in-ear plug of claim 1, wherein one or both of the center post and the adjustment collar includes a locking mechanism to selectively secure a radial position of the adjustment collar with reference to the center post.

10. The adjustable in-ear plug of claim 1, wherein rotation of the adjustment collar with reference to the center post further changes a characteristic shape of the resilient membrane tip.

11. The adjustable in-ear plug of claim 1, wherein rotation of the adjustment collar with reference to the center post is driven manually by a user.

12. The adjustable in-ear plug of claim 1, wherein rotation of the adjustment collar with reference to the center post is driven by a motor.

13. The adjustable in-ear plug of claim 1, wherein the adjustable in-ear plug is one of an earplug, in-ear monitor, and a hearing aid.

14. A method of using an adjustable in-ear plug comprising:

grasping in a user's first hand a main housing of the adjustable in-ear plug, the main housing in fixed relation to a center post;

grasping in the user's second hand a resilient membrane tip of the adjustable in-ear plug, the resilient membrane tip having a first end fixedly attached to an adjustment collar concentric with and screwed onto the center post, the resilient membrane tip further having a second end fixedly attached to an adjustment ring, the adjustment ring concentrically oriented around the center post, rotatable with reference to the center post, and fixed linearly along the center post, the resilient membrane tip covering a portion of an adjustment mechanism that includes the center post rotatably attached to the adjustment collar; and rotating the resilient membrane tip with reference to the main housing, which in turn rotates the adjustment ring and the adjustment collar with reference to the center post thereby pulling a center portion of the resilient membrane tip inward, thus changing an outside diameter of the resilient membrane tip.

15. The method of using the adjustable in-ear plug of claim 14, further comprising:

locking the adjustment collar with reference to the center post thereby fixing the outside diameter of the resilient membrane tip.

16. The method of using the adjustable in-ear plug of claim 14, further comprising:

placing the adjustable in-ear plug into the user's ear canal after rotating the resilient membrane tip with reference to the main housing.

17. The method of using the adjustable in-ear plug of claim 14, wherein rotation of the adjustment collar with reference to the center post further changes a characteristic shape of the resilient membrane tip.

18. The method of using the adjustable in-ear plug of claim 14, wherein the adjustable in-ear plug is one of an earplug, in-ear monitor, and a hearing aid.

19. An adjustable in-ear monitor comprising:

a sound tube having a threaded end;

an adjustment collar having a threaded end, the adjustment collar concentric with the sound tube, and the threaded end of the adjustment collar screwed onto the threaded end of the sound tube;

an adjustment ring concentrically oriented around the sound tube, rotatable with reference to the sound tube, and fixed linearly along the sound tube; and a resilient membrane tip having a first end fixedly attached to the adjustment collar and a second end fixedly attached to the adjustment ring, the resilient membrane tip also concentric with the sound tube and covering the adjustment collar, wherein rotation of the adjustment ring, resilient membrane tip, and adjustment collar with reference to the sound tube pulls a center portion of the resilient membrane tip inward, thus changing an outside diameter of the resilient membrane tip.

* * * * *